US007828705B2

(12) United States Patent
Nakano et al.

(10) Patent No.: US 7,828,705 B2
(45) Date of Patent: Nov. 9, 2010

(54) OSCILLATION-TYPE EXERCISE DEVICE

(75) Inventors: Toshio Nakano, Osaka (JP); Wataru Sanematsu, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/127,146

(22) Filed: May 27, 2008

(65) Prior Publication Data

US 2008/0300119 A1 Dec. 4, 2008

(30) Foreign Application Priority Data

May 28, 2007 (JP) ..... 2007-140508

(51) Int. Cl.
*A63B 26/00* (2006.01)

(52) U.S. Cl. ..... 482/142; 482/51; 434/247

(58) Field of Classification Search ..... 482/51, 482/142; 434/247, 55, 62, 64–65; 472/95–97, 472/130, 59–61; 446/7, 29, 396; 297/260.1–260.2
See application file for complete search history.

(56) References Cited

U.S. PATENT DOCUMENTS

| | | | | |
|---|---|---|---|---|
| 701,267 | A * | 5/1902 | Graf | 217/89 |
| 710,267 | A * | 9/1902 | Graff | 54/71 |
| 2,127,056 | A * | 8/1938 | Grover | 280/1.192 |
| 2,552,002 | A * | 5/1951 | Dunbar | 472/96 |
| 2,788,217 | A * | 4/1957 | Patterson | 280/1.202 |
| 3,149,837 | A * | 9/1964 | Kramm | 472/97 |
| 3,161,005 | A * | 12/1964 | Ackerson | 54/71 |
| 4,304,193 | A * | 12/1981 | Madden | 54/71 |
| 4,431,182 | A * | 2/1984 | Reynolds | 482/27 |
| 4,988,300 | A * | 1/1991 | Yamaguchi et al. | 434/247 |
| 5,533,899 | A * | 7/1996 | Young | 434/61 |
| 6,210,286 | B1 * | 4/2001 | Ohara et al. | 472/97 |
| 6,866,594 | B2 * | 3/2005 | Greenwood | 473/422 |
| 7,347,806 | B2 | 3/2008 | Nakano et al. | |
| 2004/0101811 | A1 * | 5/2004 | Gipson | 434/247 |
| 2007/0238579 | A1 | 10/2007 | Nakano | |

FOREIGN PATENT DOCUMENTS

| | | | |
|---|---|---|---|
| GB | 05291 | A * | 1/1913 |
| GB | 195215 | A * | 3/1923 |
| JP | 2-228987 | | 9/1990 |
| JP | 10-127713 | | 5/1998 |

(Continued)

OTHER PUBLICATIONS

English language Abstract of JP 11-004911.

(Continued)

*Primary Examiner*—Lori Baker
(74) *Attorney, Agent, or Firm*—Greenblum & Bernstein, P.L.C.

(57) ABSTRACT

An oscillation-type exercise device is provided with a pair of reins on the right and on the left disposed in front of a user seated on a seat portion. Base ends of the pair of the reins are coupled to a pair of extensible mechanisms housed inside the seat portion. Handle portions to be gripped by the user are attached to tip ends of the pair of reins. Each extensible mechanism is configured to change the length of the reins, that is, each extensible mechanism causes the reins to generally extend and retract.

11 Claims, 19 Drawing Sheets

FOREIGN PATENT DOCUMENTS

| | | |
|---|---|---|
| JP | 2001-286578 | 10/2001 |
| JP | 3394890 | 1/2003 |
| JP | 3102908 | 4/2004 |
| JP | 2005-245638 | 9/2005 |
| JP | 2006-149415 | 6/2006 |
| KR | 20-0337159 | 12/2003 |

OTHER PUBLICATIONS

English language Abstract of JP 2005-245638.
English language Abstract of JP 2001-286578.
English language Abstract of JP 10-127713.

* cited by examiner

OSCILLATION-TYPE EXERCISE DEVICE

BACKGROUND OF THE INVENTION

1. Field of the Invention

The present invention relates to an oscillation-type exercise device for providing exercise stress that imitates horseback riding to the user seated on the seat portion by oscillating the seat portion.

2. Background Art

There have been proposed various oscillation-type exercise devices for providing exercise stress that imitates horseback riding to the user seated on the seat portion by oscillating the seat portion. The oscillation-type exercise devices of this type were initially used in health care facilities with the aim of rehabilitation exercise and are now coming into wide use in the home as a convenient exercise machine available from children to elder people. Typical prior arts of such an oscillation-type exercise device are, for example, the following three devices.

A lower back pain preventive exercise device disclosed in Japanese Patent No. 3394890 is configured in such a manner that the position of the seat on which the trainee sits astride can be changed in the front-rear direction, the right-left direction, and the top-bottom direction using a hexaxial parallel mechanism or the like and thereby enables a series of smooth oscillation patterns.

An electric chair disclosed in JP-A-2005-245638 is configured in such a manner that the disc-shaped seat portion of the chair oscillates to undulate up and down while the seat portion rotates to reciprocate from right to left and vice versa.

A balance exercise device disclosed in JP-A-2001-286578 is configured to oscillate the seat portion on which an individual is seated in the front-rear direction and in the right-left direction using one motor and a link.

Each of the devices described above exerts an exercise effect to the lower back and the legs. Accordingly, the user of these devices has to practice another exercise using dumbbells or the like for the upper half of the body.

SUMMARY OF THE INVENTION

An object of the invention is to provide an oscillation-type exercise device that solves the problem discussed above.

Another object of the invention is to provide an oscillation-type exercise device capable of exerting an exercise effect not only to the lower back and the legs but also to the upper half of the body.

An oscillation-type exercise device according to one aspect of the invention includes: a seat portion on which a user is seated; an exercise mechanism that allows the seat portion to undergo oscillation motion; a rein positioned in front of the user seated on the seat portion so as to be gripped by the user; and an extensible mechanism that causes the rein to extend and retract.

An oscillation-type exercise device according to another aspect of the invention includes: a seat portion on which a user is seated; an exercise mechanism that allows the seat portion to undergo oscillation motion; and a rein having elasticity and disposed in front of the user seated on the seat portion so as to be gripped by the user.

DETAILED DESCRIPTION OF THE PREFERRED EMBODIMENTS OF THE INVENTION

First Embodiment

Hereinafter, a first embodiment as an implementation of the invention will be described with FIG. 1A through FIG. 7C.

Figure 1A:
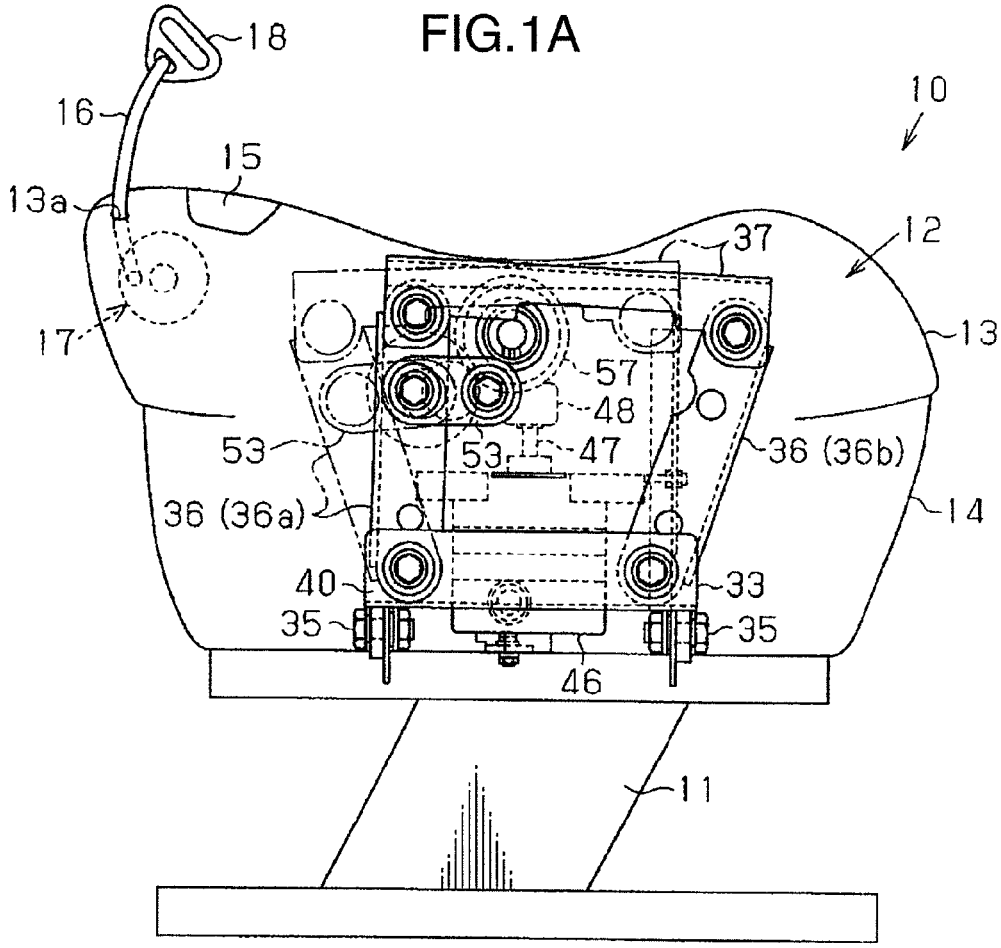
FIG. 1A is a side view showing the overall configuration of an oscillation-type exercise device of a first embodiment.

As is shown in FIG. 1A, a leg portion 11 of an oscillation-type exercise device 10 is mounted on an unillustrated floor surface and a driving device 12 as an exercise mechanism is fixed to the upper end of the leg portion 11. A seat portion 13 that imitates the shape of the back of a horse or the saddle for the user to be seated thereon is fixed to the top portion of the driving device 12. The driving device 12 is configured so as to oscillate the seat portion 13 in the front-rear direction and the right-left direction. The driving device 12 is covered with a cover 14 provided between the upper end of the leg portion 11 and the seat portion 13. The cover 14 is made of stretchable fabric or the like and allows for oscillation of the seat portion 13 induced by the driving device 12. It should be noted that the cover 14 is made of more than one material.

A console device 15 is provided to the seat portion 13 in the top surface on the front side (on the left side in the drawing). Instructions to start and stop the driving device 12 and to change a motion condition are provided by operations on unillustrated switches provided to the console device 15.

Reins 16 formed in the shape of a tube are provided to the front end of the seat portion 13. The reins 16 are provided to the seat portion 13 on both the right and left sides. In short, a pair of the reins 16 on the right and on the left are provided in this embodiment. The seat portion 13 is provided with an insertion hole 13*a* made on each of the right and left sides. The base ends of the respective reins 16 are inserted inside the seat portion 13 through the corresponding insertion holes 13*a*. The base ends of the respective reins 16 are coupled to extensible mechanisms 17 housed inside the seat portion 13. Two extensible mechanisms 17 are provided to correspond to the respective reins 16. Handle portions 18 are attached to the tip ends of the respective reins 16. Each handle portion 18 has a ring-like portion formed almost in the shape of a ring so as to be griped by the user.

Figure 1B:
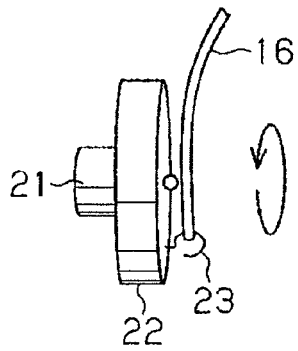
FIG. 1B is a view schematically showing the configuration of an extensible mechanism.

FIG. 1B shows the extensible mechanism 17 on the left side. Although the illustration of the extensible mechanism 17 on the right side is omitted herein, it is formed symmetric with respect to the extensible mechanism 17 on the left side. A motor 21 for extension and retraction in the extensible mechanism 17 is provided on the inner side of the seat portion 13 and fixed to the seat portion 13. A rotary plate 22 is fixed to the output shaft (not shown) of the motor 21 for extension and retraction. The base end of the rein 16 is coupled to a coupling portion 23 fixed to the rotary plate 22. The position at which the coupling portion 23 is fixed is set off center from the rotation center of the rotary plate 22. In other words, the base end of the rein 16 is fixed to the rotary plate 22 at a position displaced from the rotation center thereof in the radial direction. Accordingly, when the rotary plate 22 is rotated by the driving of the motor 21, the distance from the base end of the rein 16 to the insertion hole 13*a* varies. More specifically, the extensible mechanism 17 substantially extends or shortens the length of the rein 16 from the insertion hole 13*a* to the tip end thereof, that is, the length of the exposed portion of the rein 16.

Figure 2:
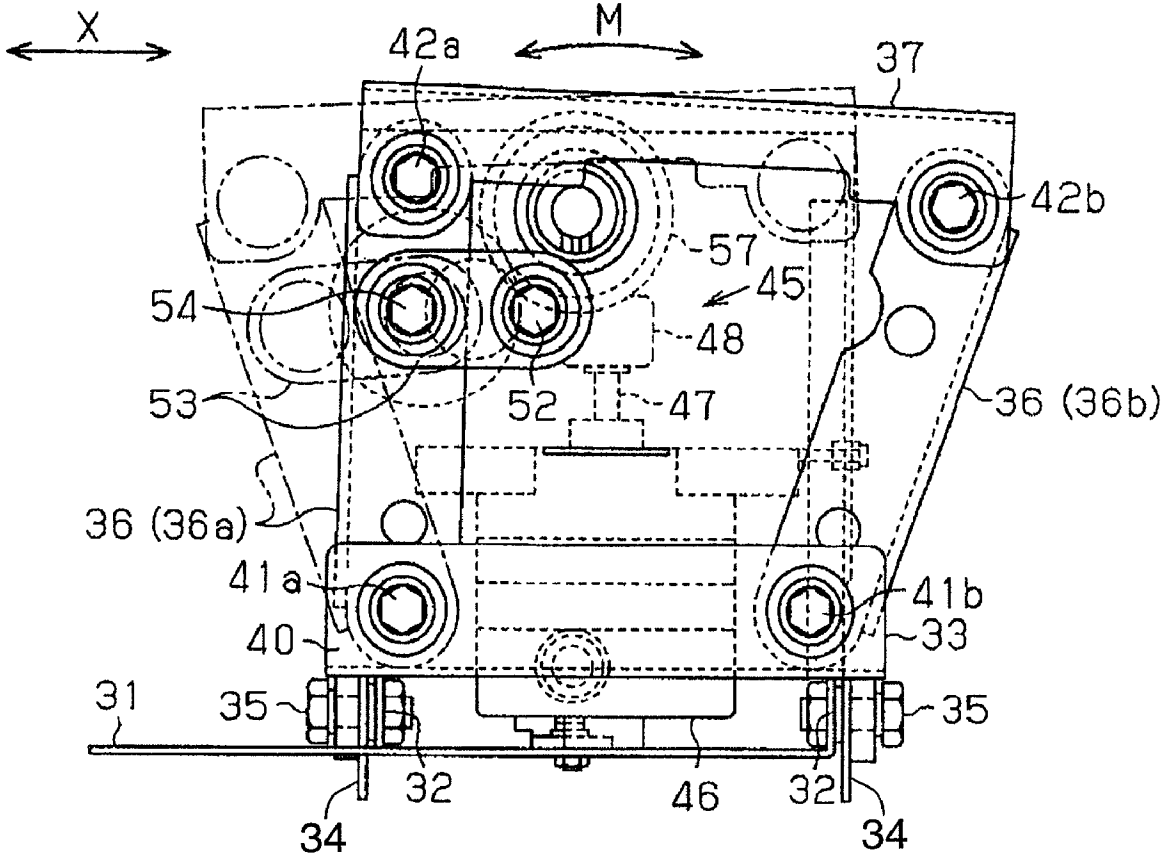
FIG. 2 is a side view of a driving device.
Figure 3:
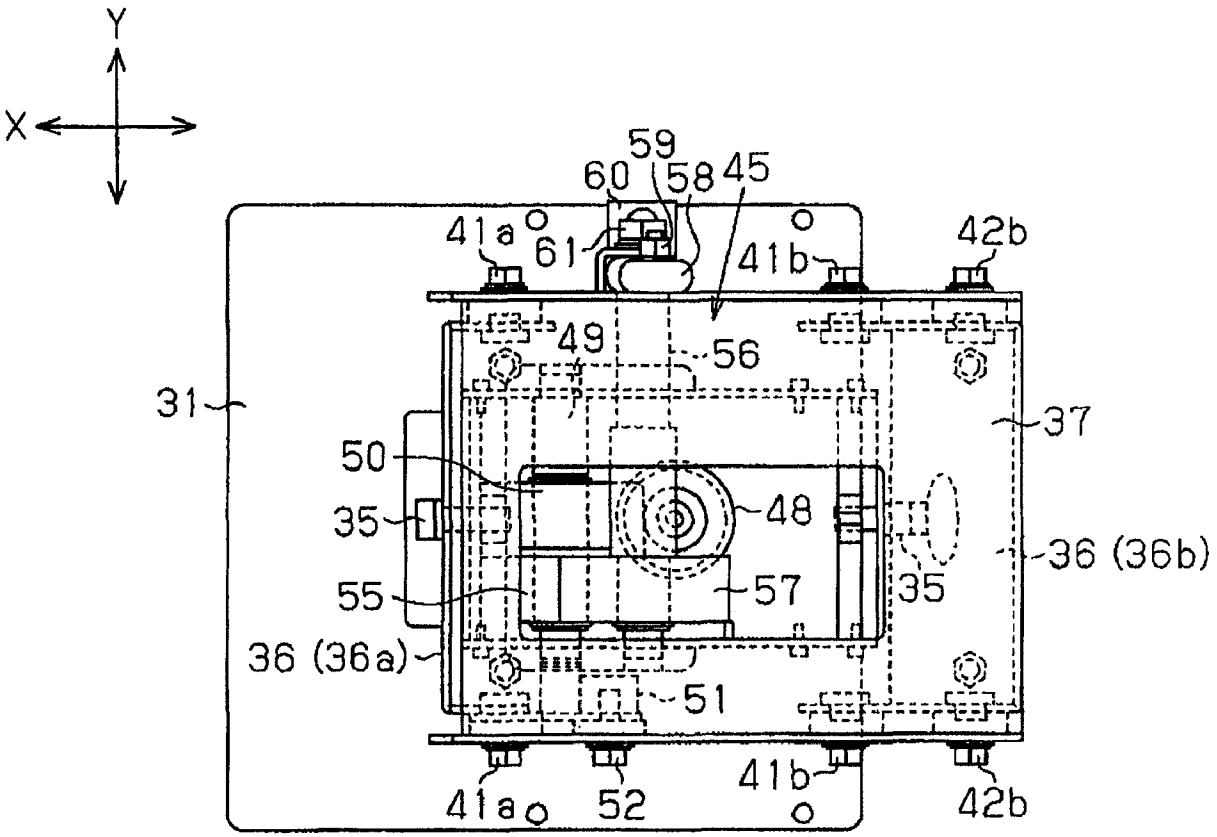
FIG. 3 is a plane view of the driving device.
Figure 4:
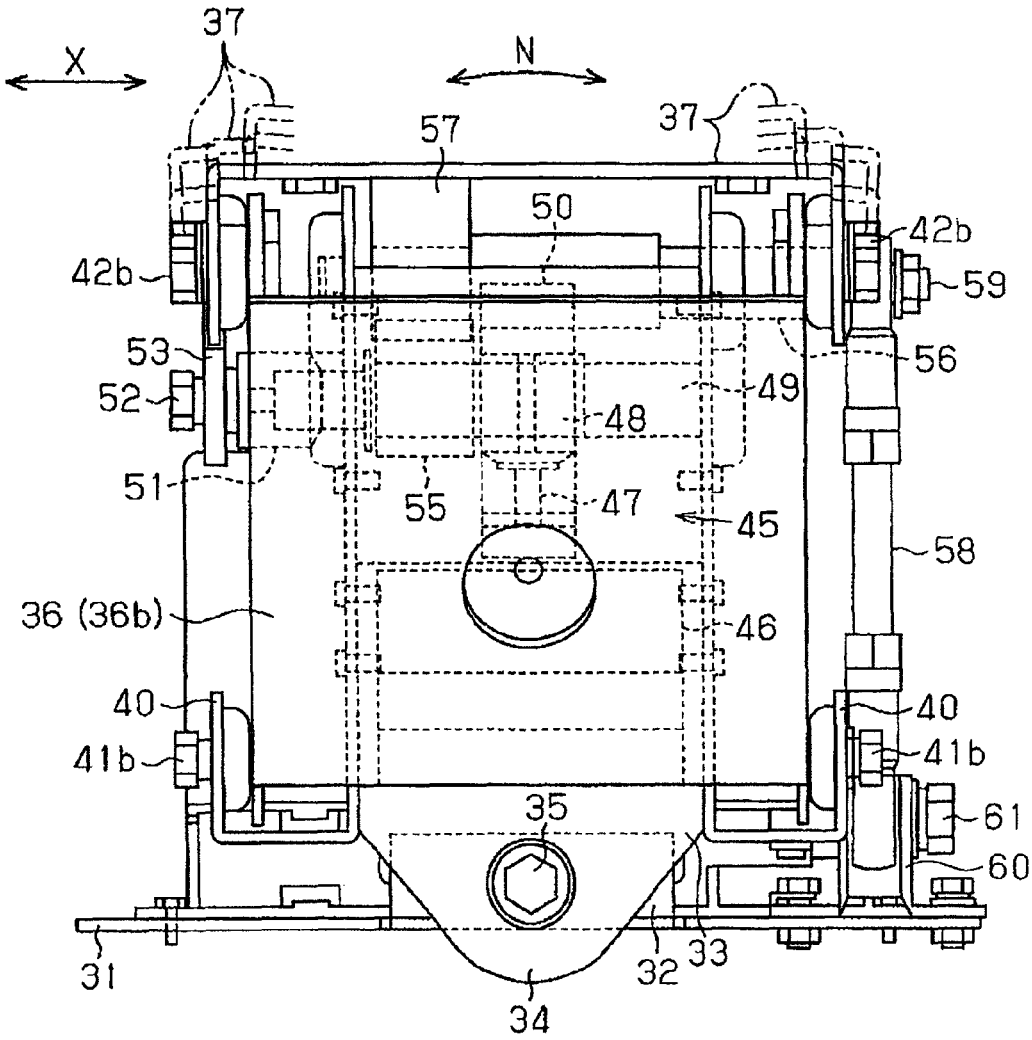
FIG. 4 is another side view of the driving device.

The driving device 12 will be schematically described with FIG. 2 to FIG. 4.

As is shown in FIG. 3, a base 31 shaped like a rectangular plate is fixed to the top surface of the leg portion 11 shown in FIG. 1A, and as is shown in FIG. 2, axial supporting plates 32 that make a pair in the front-rear direction are provided to stand on the base 31. A pair of coupling plates 34 provided to a movable stand 33 so as to droop down at the both end portions thereof in the front-rear direction is disposed oppositely to a pair of the axial supporting plates 32. The axial supporting plates 32 and the coupling plates 34 are coupled to each other in a rotatable manner by spindles 35 extending along the front-rear direction. The spindles 35 are disposed at two points in the front and the rear of the base 31 at the center in the right-left direction to support the movable stand 33 in a rotatable manner in the right-left direction.

As is shown in FIG. 2, a pedestal 37 is supported on the movable stand 33 via a coupling link 36 in such a manner that oscillations in the front-rear direction are enabled. The pedestal 37 is disposed above the movable stand 33 and the seat portion 13 is attached to the pedestal 37.

Hereinafter, detailed descriptions will be given. As is shown in FIG. 4, a pair of side plates 40 extending in the front-rear direction is provided to the movable stand 33 on both the right and left sides. As is shown in FIG. 3, the coupling link 36 has a front link 36*a* disposed frontward and a rear link 36*b* disposed rearward. As is shown in FIG. 2, the lower end portion of the front link 36*a* is attached to lower axial pins 41*a* provided to the front end portions of the side plates 40 in a rotatable manner. The upper end portion of the front link 36*a* is attached to upper axial pins 42*a* provided to the front end portion of the pedestal 37 in a rotatable manner. The lower end portion of the rear link 36*b* is attached to lower axial pins 41*b* provided to the rear end portions of the side plates 40 in a rotatable manner. The upper end portion of the rear link 36*b* is attached to the upper axial pins 42*b* provided to the rear end portion of the pedestal 37 in a rotatable manner. The respective lower axial pins 41*a* and 41*b* in the front and the rear respectively form left and right shafts that support the coupling link 36 in a rotatable manner about the axial line extending in the right-left direction Y. This configuration allows the pedestal 37 to move and rotate about the right and left shafts in a reciprocable manner. In short, the pedestal 37 is allowed to oscillate in the front-rear direction (a direction indicated by an arrow M in FIG. 2). Also, as is shown in FIG. 4, the pedestal 37 rotates in the right-left direction integrally with the movable stand 33 owing to the coupling link 36. The pedestal 37 is therefore allowed to move and rotate about the spindles 35 supporting the movable stand 33 in a reciprocable manner. In short, the pedestal 37 is allowed to oscillate in the right-left direction (a direction indicated by an arrow N in FIG. 4)

A center distance between the lower axial pins 41*a* and 41*b* in the front and the rear is set shorter than a center distance between the upper axial pins 42*a* and 42*b* in the front and the rear. Hence, as is indicated by a solid line in FIG. 2, when the front link 36*a* is almost at a right angle with respect to the base 31, the rear link 36*b* yields a specific angle with respect to the base 31. Accordingly, the rear end of the pedestal 37 becomes lower than the front end. In short, the pedestal 37 inclines rearward. Conversely, as is indicated by a virtual line in FIG. 2, when the rear link 36*b* is almost at a right angle with respect to the base 31, the front link 36*a* yields a specific angle with respect to the base 31. Accordingly, the front end of the pedestal 37 becomes lower than the rear end. In short, the pedestal 37 inclines frontward. The seat portion 13 fixed to the pedestal 37 is thus inclined frontward and rearward.

A driving portion 45 is accommodated in a space between the base 31 and the pedestal 37. The driving portion 45 is to oscillate the pedestal 37 with respect to the base 31. A motor 46 of the driving portion 45 is fixed to the base 31 so that an output shaft 47 thereof protrudes upward. A motor gear 48 is fixed to the output shaft 47. A first gear 50 is meshed with the motor gear 48. The first gear 50 is coaxially fixed to a first shaft 49 extending along the right-left direction and supported on the pedestal 37 at the both ends. An eccentric crank 51 is coupled to one end of the first shaft 49, and a first end portion of an arm link 53 is attached to the eccentric crank 51 by an axial pin 52 in a rotatable manner. A second end portion of the arm link 53 is attached to the front link 36*a* in a rotatable manner by an axial pin 54. Accordingly, the eccentric crank 51 undergoes eccentric circular motion with respect to the first shaft 49 with rotations of the motor 46. The front link 36*a* thus moves to reciprocate in the front-rear direction X, which causes the seat portion 13 to oscillate in the direction indicated by the arrow M in FIG. 2. As are shown in FIG. 2 and FIG. 3, the motor 46 (output shaft 47), the motor gear 48, the first shaft 49, the first gear 50, the eccentric crank 51, and the arm link 53 together form a first driving portion.

As is shown in FIG. 3, an interlocking gear 55 fixedly attached to the first shaft 49 is meshed with a second gear 57. The second gear 57 is fixed to a second shaft 56 supported on the movable stand 33. The upper end of an eccentric rod 58 is coupled to one end (right end in FIG. 4) of the second shaft 56. The eccentric rod 58 is set off center from the rotation center of the second shaft 56 by an axial pin 59. The lower end of the eccentric rod 58 is coupled to a coupling fitting 60 fixed to the base 31 by an axial pin 61 in a rotatable manner. Hence, the upper end of the eccentric rod 58 undergoes eccentric circular motion with rotations of the second shaft 56, which causes the movable stand 33, that is, the pedestal 37 and the seat portion 13, to oscillate in the direction indicated by the arrow N in FIG. 4. As are shown in FIGS. 2 through 4, the motor 46 (output shaft 47), the motor gear 48, the first gear 50, the first shaft 49, the second shaft 56, the second gear 57, and the eccentric rod 58 together form a second driving portion.

The respective gears in the first driving portion and the second driving portion are set to cause the seat portion 13 to reciprocate twice in the front-back direction while it reciprocates once in the right-left direction. Accordingly, when the oscillation-type exercise device 10 is viewed from above, the seat portion 13 is oscillated in a figure of eight to reproduce motion imitating the horseback riding.

Owing to the first driving portion and the second driving portion configured as above, the seat portion 13 not only oscillates in the direction indicated by the arrow M in FIG. 2 but also oscillates in the direction indicated by the arrow N shown in FIG. 4. By combining these oscillations, the seat portion 13 is allowed to oscillate in a θX direction about the X axis, a θY direction about the Y axis direction, and a θZ direction about the vertical axis (Z axis). It is thus possible to train the body balance function and the motor function of the user. Moreover, because three types of motion are enabled using the single motor 46, the number of the motors 46 can be lessened. Hence, not only can the control be simpler, but also the device can be reduced both in cost and size. Further, because the output shaft 47 of the motor 46 only has to protrude in one direction, the motor 46 can be installed in a longitudinal orientation. It is thus possible to reduce driving device 12 including the motor 46 in size by narrowing an overall installment space. Motion imitating the horseback riding can be therefore reproduced faithfully as intended by the driving device 12 accommodated in a space between the base 31 that supports the seat portion 13 and the pedestal 37.

Figure 5:
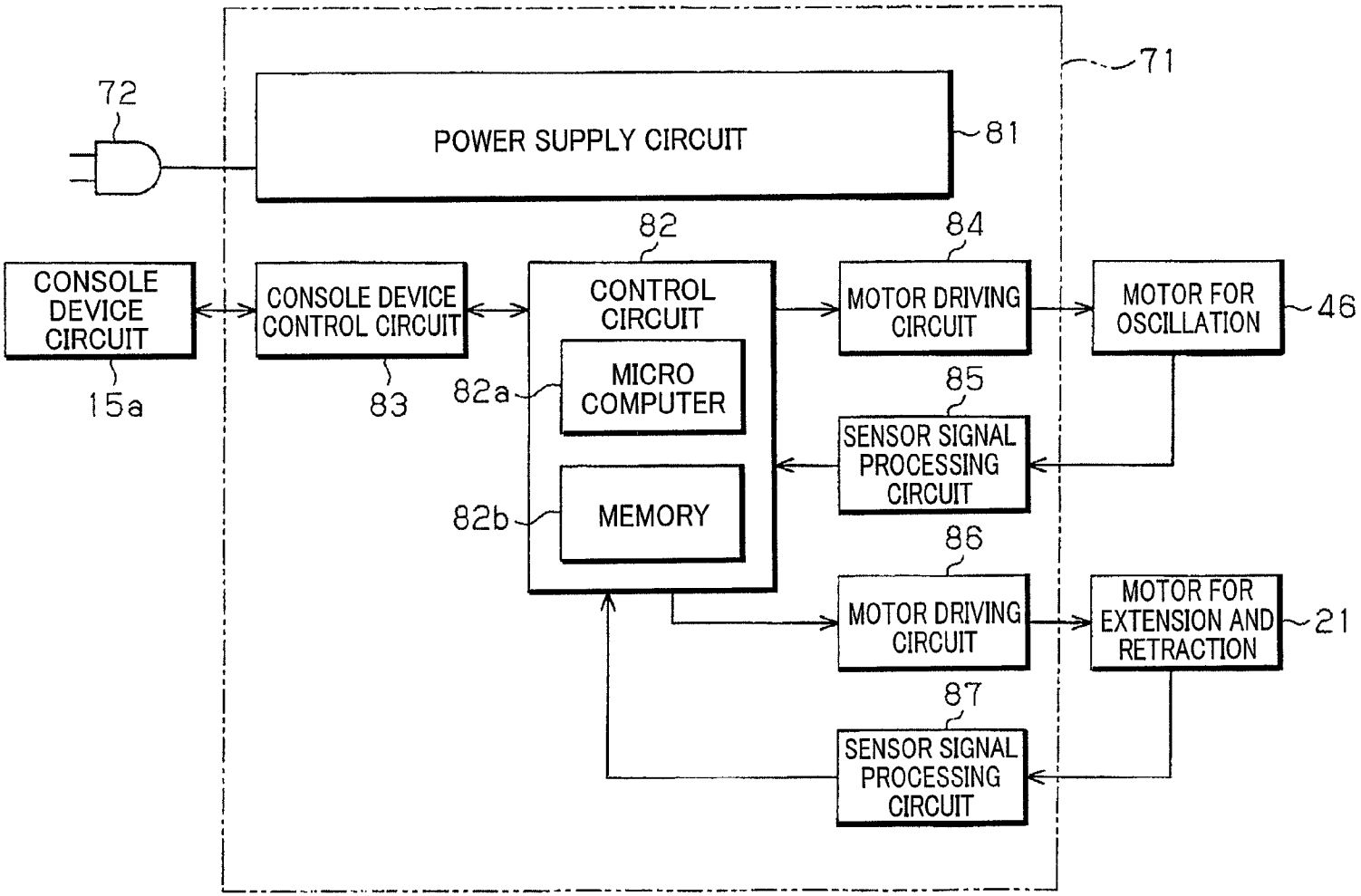
FIG. 5 is a block diagram depicting the electric configuration of the oscillation-type exercise device.

FIG. 5 is a block diagram showing the electrical configuration of the oscillation-type exercise device 10.

A power supply circuit 81 mounted on a circuit board 71 converts a commercial alternating current inputted therein via a power source plug 72 to a direct current at 140V, 15V, and the like and supplies the converted direct current to respective circuits within the circuit board 71. A control circuit 82 mounted on the circuit board 71 includes a micro computer 82*a* and a memory 82*b* having recorded patterns of driving motion. It is connected to a console device control circuit 83, a motor driving circuit 84, a sensor signal processing circuit 85, another motor driving circuit 86, and another sensor signal processing circuit 87. A console device circuit 15*a* provided to the console device 15 shown in FIG. 1A is connected to the console device control circuit 83. The console device circuit 15*a* is provided with switches for operations and a display device, such as an LED, for displaying thereon a condition or the like. The motor driving circuit 84 is connected to the motor 46 for oscillation (see FIG. 2) described above. The motor 46 is provided with a sensor (not shown) to detect the rotation speed and the rotation position, and an output of the sensor is inputted into the sensor signal processing circuit 85. The motor driving circuit 86 is connected to the motors 21 for extension and retraction (see FIG. 1A). Each motor 21 is provided with a sensor (not shown) to detect the rotation speed and the rotation position, and an output of the sensor is inputted into the sensor signal processing circuit 87.

The control circuit 82 receives a signal corresponding to an operation on the switches of the console device circuit 15*a* via the console device control circuit 83. The control circuit 82 drives the motors 46 and 21 while controlling the numbers of rotations thereof via the motor driving circuits 84 and 86, respectively, under its control according to signals received from the console device control circuit 83 and the sensor signal processing circuits 85 and 87. Also, the control circuit 82 controls the display device of the console device 15 via the console device control circuit 83 to display thereon a motion condition or the like.

The memory 82*b* of the control circuit 82 pre-stores parameters to control the motors 46 and 21 according to the patterns of driving motion. The control circuit 82 (substantially, the micro computer 82*a*) reads out the parameter corresponding to the operation on the switches provided to the console device 15 from the memory 82*b*, and drives the motors 46 and 21 via the motor driving circuits 84 and 86, respectively, under its control according to the parameter thus read out.

In this embodiment, one of the parameters stored in the memory 82*b* is a parameter to drive the motors 21 for extension and retraction shown in FIG. 1B. This parameter is set in such a manner that the rotary plates 22 shown in FIG. 1B rotate once while the seat portion 13 shown in FIG. 1A reciprocates once in the front-rear direction.

One of the driving patterns stored in the memory 82*b* is to vary a tensile force of the reins 16 held by the user seated on the seat portion 13. The tensile force of the reins 16 varies with a change of the length of the reins 16 held by the user in a portion present on the outside of the seat portion 13. More specifically, when the control circuit 82 drives the motors 21 forming the extensible mechanisms 17 while the user seated on the seat portion 13 is holding the reins 16 (gripping the handle portions 18 attached to the tip ends), the reins 16 repetitively extend and retract in cycles with rotations of the motors 21 and the rotary plates 22. The user is therefore pulled frontward in response to retraction of the reins 16. That is to say, the user feels a variance in tensile force of the reins 16. In other words, the extensible mechanisms 17 force the reins 16 to retract or extend against a force from the user pulling the reins 16. This motion forces the upper half of the body of the user to move, and thereby induces a muscle activity.

Figure 6:
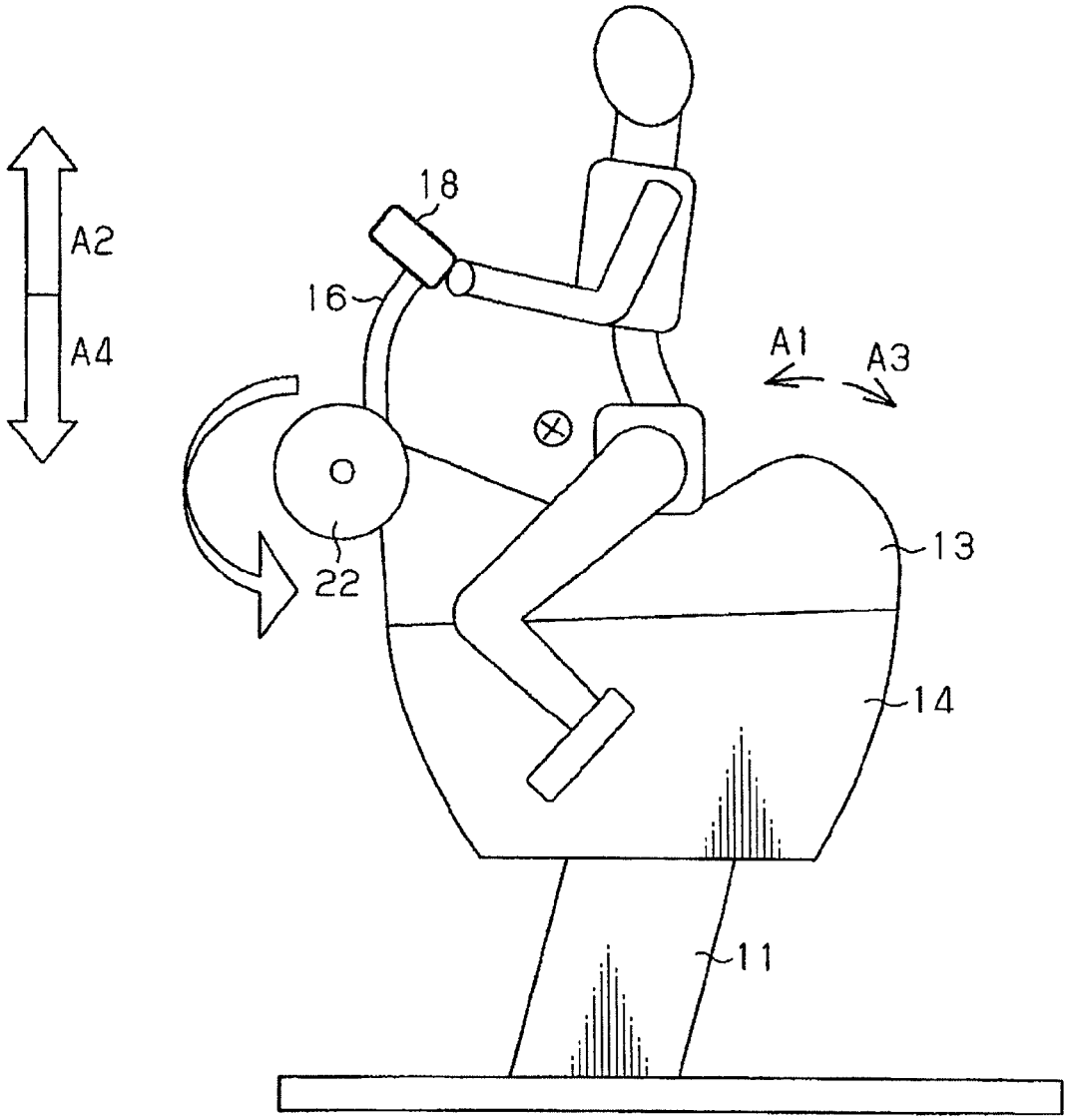
FIG. 6 is a schematic view showing motion of the oscillation-type exercise device.

Further, the driving patterns are set so that the tensile force of the reins 16 varies with a movement of the seat portion 13. For example, as is shown in FIG. 6, they are set so that the reins 16 extend (arrow A2) when the seat portion 13 moves frontward (arrow A1), and the reins 16 retract (arrow A4) when the seat 13 moves rearward (arrow A3).

Figure 7A:
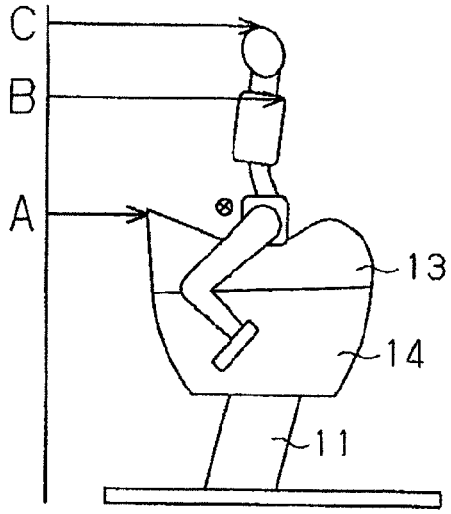
FIG. 7A is a schematic view showing measurement positions.
Figure 7B:
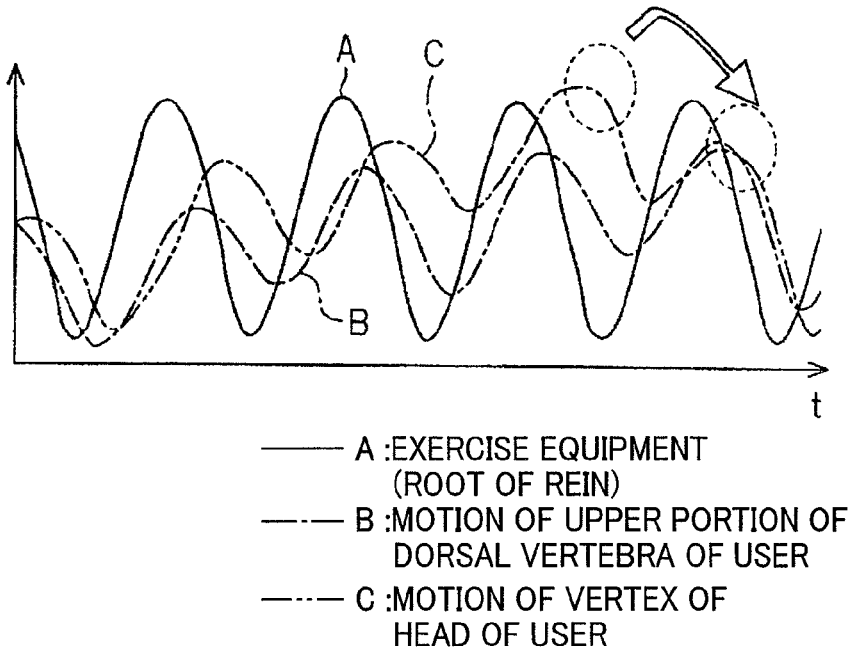
FIG. 7B is a wave form chart showing measurement results.

For the user seated on the seat portion 13, as is shown in FIG. 7A, motion of the seat portion 13, motion of the upper portion of the dorsal vertebra of the user, and motion of the vertex of the head of the user are measured. Then, as is shown in FIG. 7B, there are phase shifts (delays) in motion among the seat portion 13, the upper portion of the dorsal vertebra, and the vertex of the head. The motion of the upper portion of the dorsal vertebra delays from the motion of the seat portion 13. Further, the motion of the vertex of the head is delayed from the motion of the upper portion of the dorsal vertebra. For example, given that the cycle of movements of the seat portion 13 in the front-rear direction is 0.6 to 1.6 Hz, then a delay of about ⅕ cycle and a delay of about ¼ to ⅓ cycle occur in the upper portion of the dorsal vertebra and the vertex of the head, respectively. It should be noted that portions enclosed by a broken line in FIG. 7B indicate that the user actively catches up for a delay of the motion of the vertex of the head from the motion of the upper part of the dorsal vertebra.

Hence, by generating a tensile force by causing the reins 16 to extend and retract in response to the motion of the upper half of the body, a nerve reflex to achieve a balance is triggered in the user. It is thus possible to induce a muscle activity in the upper half of the body (the arms, the chest, and so forth) of the user.

As has been described above, the following advantages can be achieved by this embodiment.

(1) A pair of the reins 16 on the right and on the left is provided to the front end of the seat portion 13 on which the user is seated. The base ends of a pair of the reins 16 are coupled to a pair of the extensible mechanisms 17 housed inside the seat portion 13 at the tip end thereof. The handle portions 18 formed almost in the shape of a ring are attached to the tip ends of a pair of the reins 16 so as to be gripped by the user. The extensible mechanisms 17 drive the corresponding rotary plates 22 to rotate by the driving of the corresponding motors 21, and change the length of the corresponding reins 16 coming outside of the seat portion 13. In short, they cause the reins 16 to substantially extend and retract. In other words, they are capable of forcedly changing the relative positions of the handle portions 18 with respect to the seat portion 13. Hence, not only is it possible to exert an exercise effect to the lower back and the legs of the user by oscillating the seat portion 13, but it is also possible to exert an exercise effect to the upper half of the body owing to a muscle activity in the upper half of the body (the arms, the chest, and so forth) of the user induced by a nerve reflex to achieve a balance triggered in the user by the tensile force generated from the extension and retraction of the reins 16 in response to the motion of the upper half of the body.

(2) The motors 21 for extension and retraction in the extensible mechanisms 17 are fixed inside the seat portion 13, and the rotary plates 22 are fixed to the output shafts (not shown) of the corresponding motors 21 for extension and retraction. The base ends of the reins 16 are coupled to the corresponding coupling portions 23 fixed to the rotary plates 22, and the positions at which are fixed the coupling portions 23 are set off center from the rotation center of the rotary plates 22. Hence, not only is it possible to cause the reins 16 to extend and retract with rotations of the motors 21 with ease, but it is also possible to change the cycles of extension and retraction with ease.

Second Embodiment

Hereinafter, a second embodiment as another implementation of the invention will be described with FIG. 8. Like members are labeled with like reference numerals with respect to the first embodiment, and the illustration and the description of such members are omitted herein, either entirely or partially.

Figure 8:
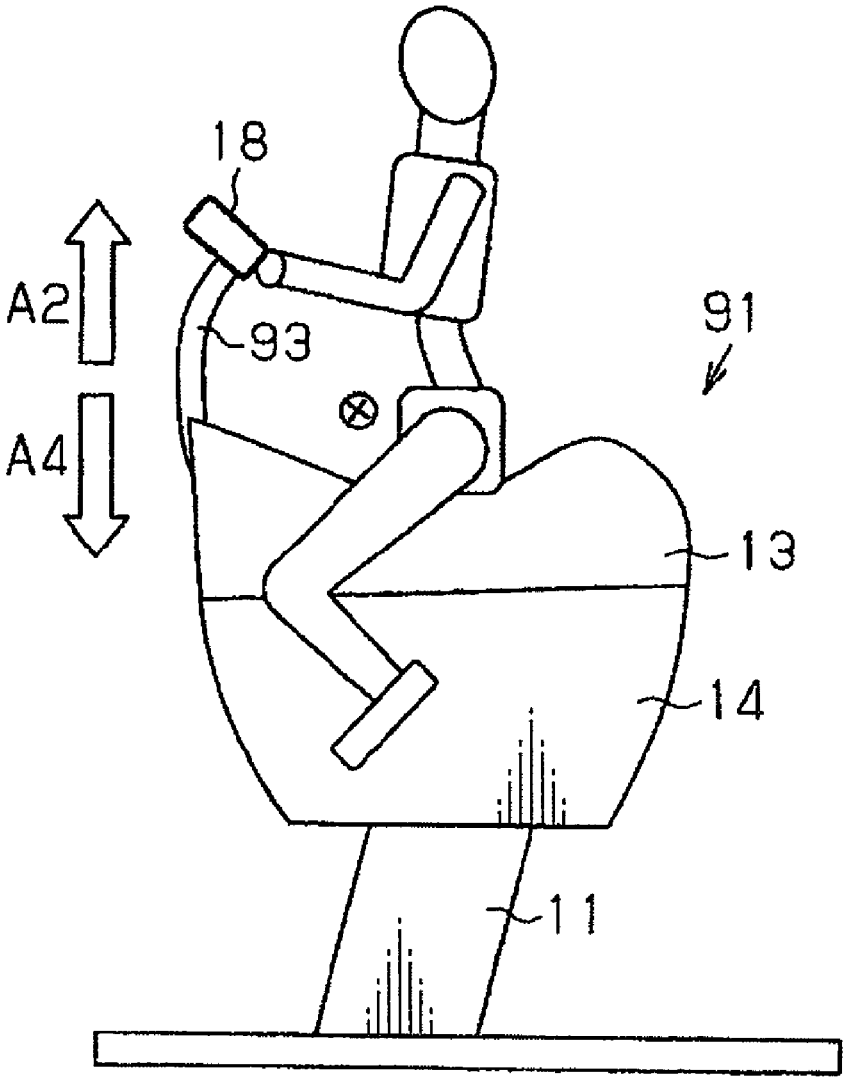
FIG. 8 is a side view schematically showing the overall configuration of an oscillation-type exercise device of a second embodiment.

As is shown in FIG. 8, the base ends of a pair of reins 93 on the right and on the left are fixed to the front end of the seat portion 13 of an oscillation-type exercise device 91 of this embodiment. The reins 93 of this embodiment are made of a material having elasticity (rubber in this embodiment) and formed in a specific shape (for example, a tube-like shape). The handle portion 18 is attached to the tip end of each rein 93. The handle portion 18 has a ring-like portion formed almost in the shape of a ring so as to be gripped by the user. The length of the reins 93 when unstretched is set in such a manner that the elbows of the user are bent at about 90 degrees.

Figure 9A:
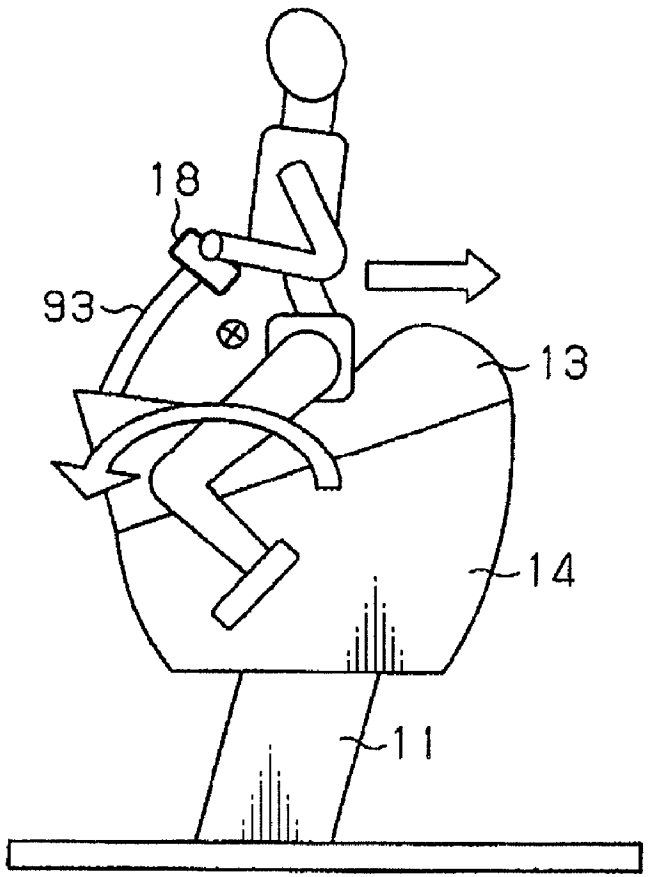
FIG. 9A and FIG. 9B are views used to describe phase shifts.
Figure 9B:
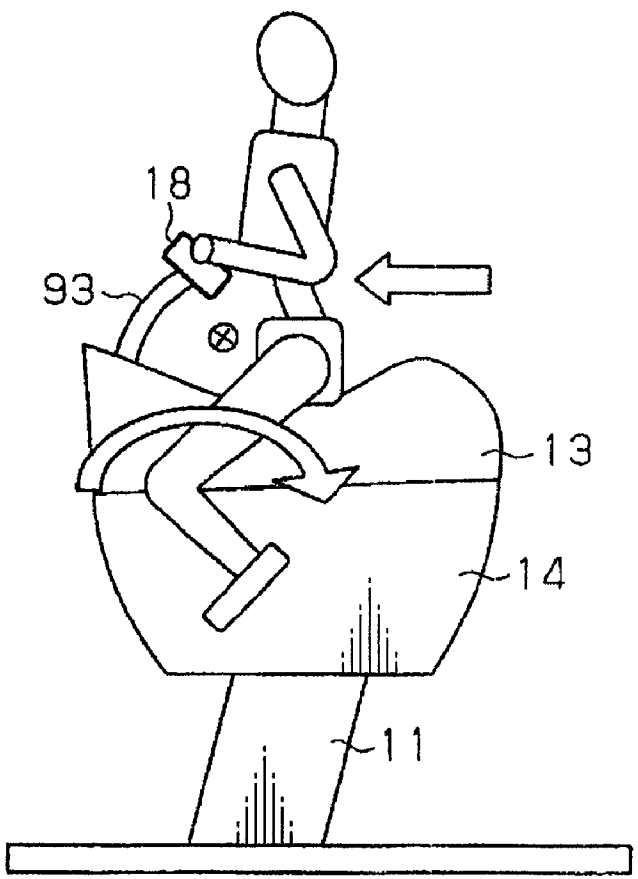

In the oscillation-type exercise device 91 configured in this manner, as are shown in FIGS. 9A and 9B, the distance between the upper half of the body of the user and the seat portion 13 varies with shifts in motion (phase shifts) generated between the seat portion 13 and the upper half of the body with oscillations of the seat portion 13 in the same manner as described in the first embodiment above. Hence, a tensile force of the reins 93 can vary when the reins 93 having elasticity are used. Accordingly, motion (joint motion) and a muscle activity are induced in the upper half of the user in association with the motion of the oscillation-type exercise device 91. The user therefore becomes able to train the upper half of the body while minimizing his efforts like motion made with his will.

The exercise effect of the oscillation-type exercise device 91 configured as above will now be described.

Figure 10B:
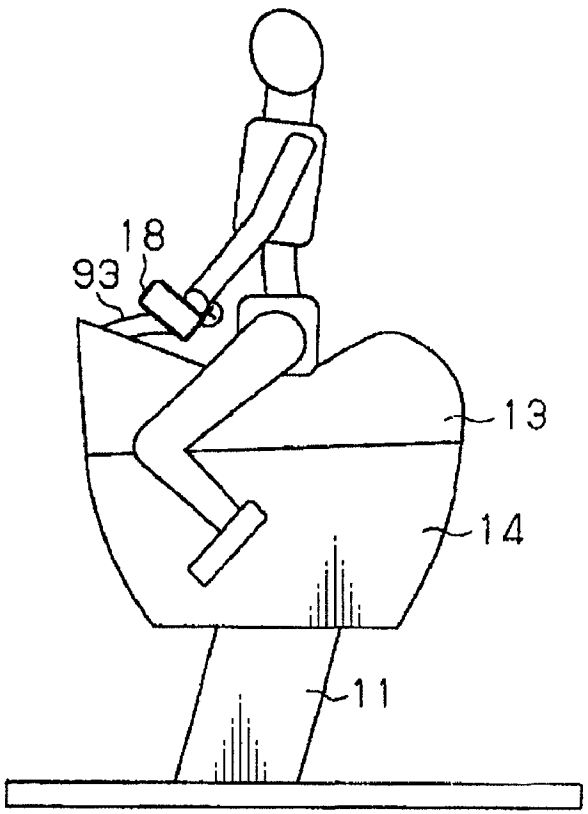
FIG. 10A and FIG. 10B are schematic views showing exercise conditions.
Figure 10A:
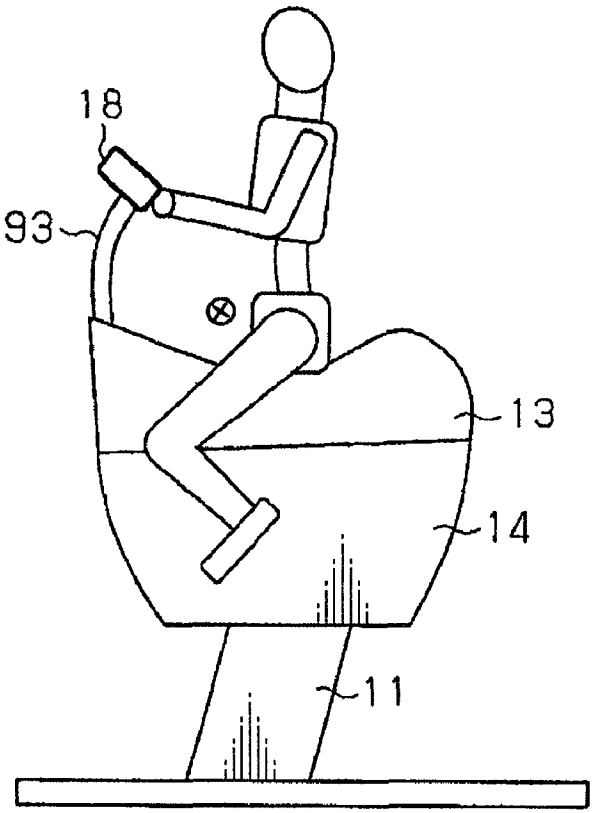
Figure 11:
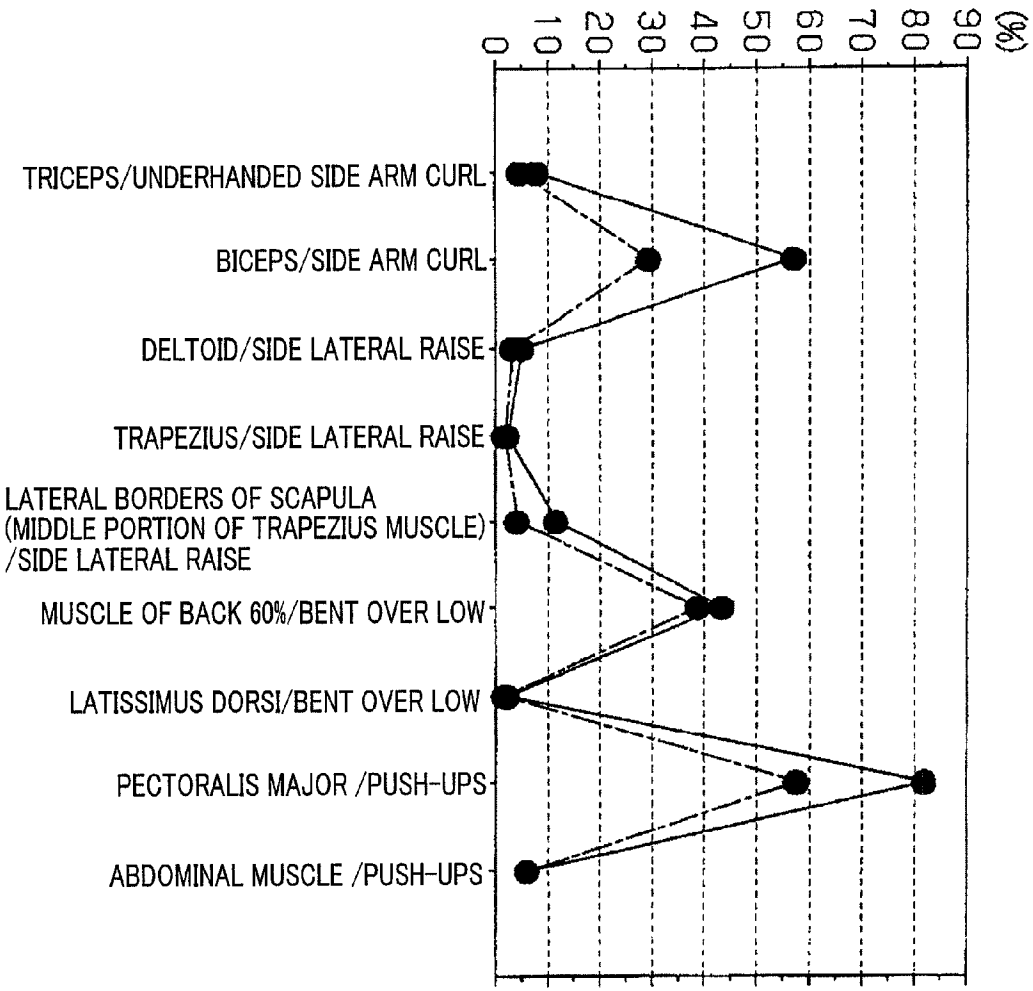
FIG. 11 is a view used to describe amounts of muscle activities.

Regarding the posture of the user who is being oscillated, assume that the user is in a state where he stretches the elbows down as is shown in FIG. 10B, and in a state where he bends the elbows and supports the reins 93 upward from the under side as is shown in FIG. 10A. In FIG. 11, an amount of exercise in the state of FIG. 10B is indicated by an alternate long and short dash line, and an amount of exercise in the state of FIG. 10A is indicted by a sold line. In FIG. 11, the ordinate is used for ratio of the load by the exercise device to the load applied by the muscle training using dumbbells weighing 3 Kg in terms of the load expressed in percentage, and the abscissa is used for muscle regions and exercises to provide muscle activities to these muscle regions. It is understood from FIG. 11 that when the user uses the oscillation-type exercise device 91 in the postures shown in FIGS. 10A and 10B, muscle activities are induced in the pectoralis major, the biceps, and the muscle of the back. Hence, it can be expected that the upper arms are slimed down and the breasts are lifted up.

Figure 12:
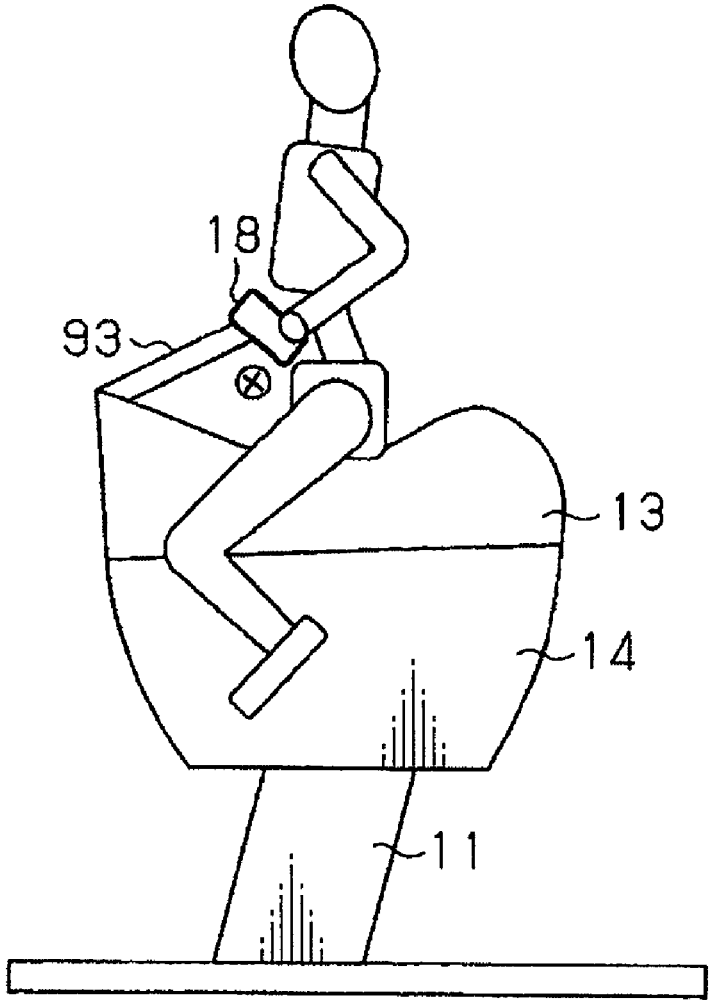
FIG. 12 is a schematic view showing a measurement condition.

As another example, when the user uses the oscillation-type exercise device 91 in a posture in which he bends the elbows and pulls the elbows behind the upper half of the body as is shown in FIG. 12, muscle activities are induced in the upper arms (in particular, on the rear side), the back, and the shoulders. Hence, it can be expected that the upper arms are slimed down and the posture is straightened up.

Figure 13A:
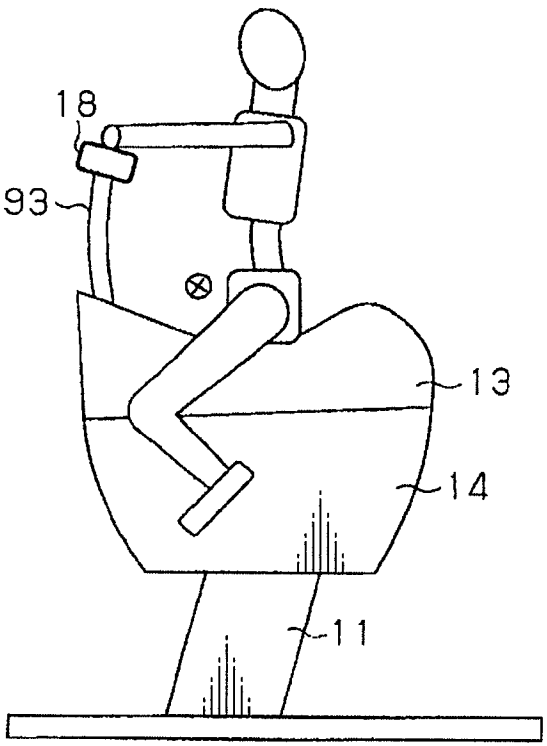
FIG. 13A and FIG. 13B are schematic views showing exercise conditions.
Figure 13B:
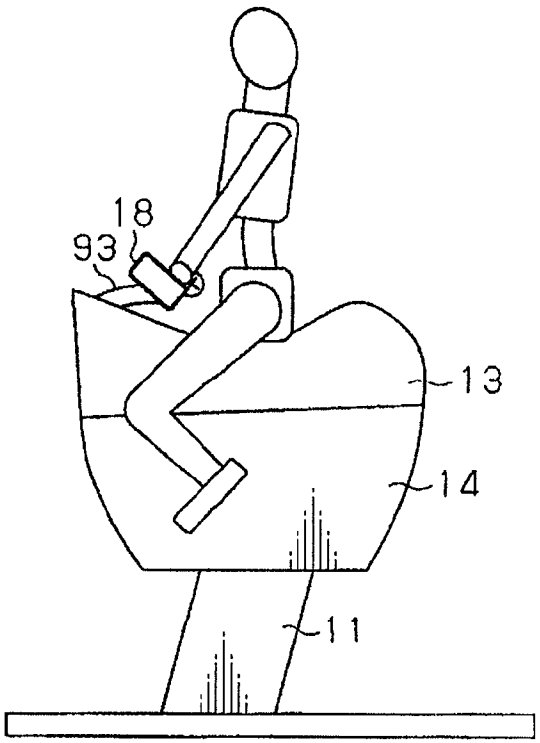
Figure 14:
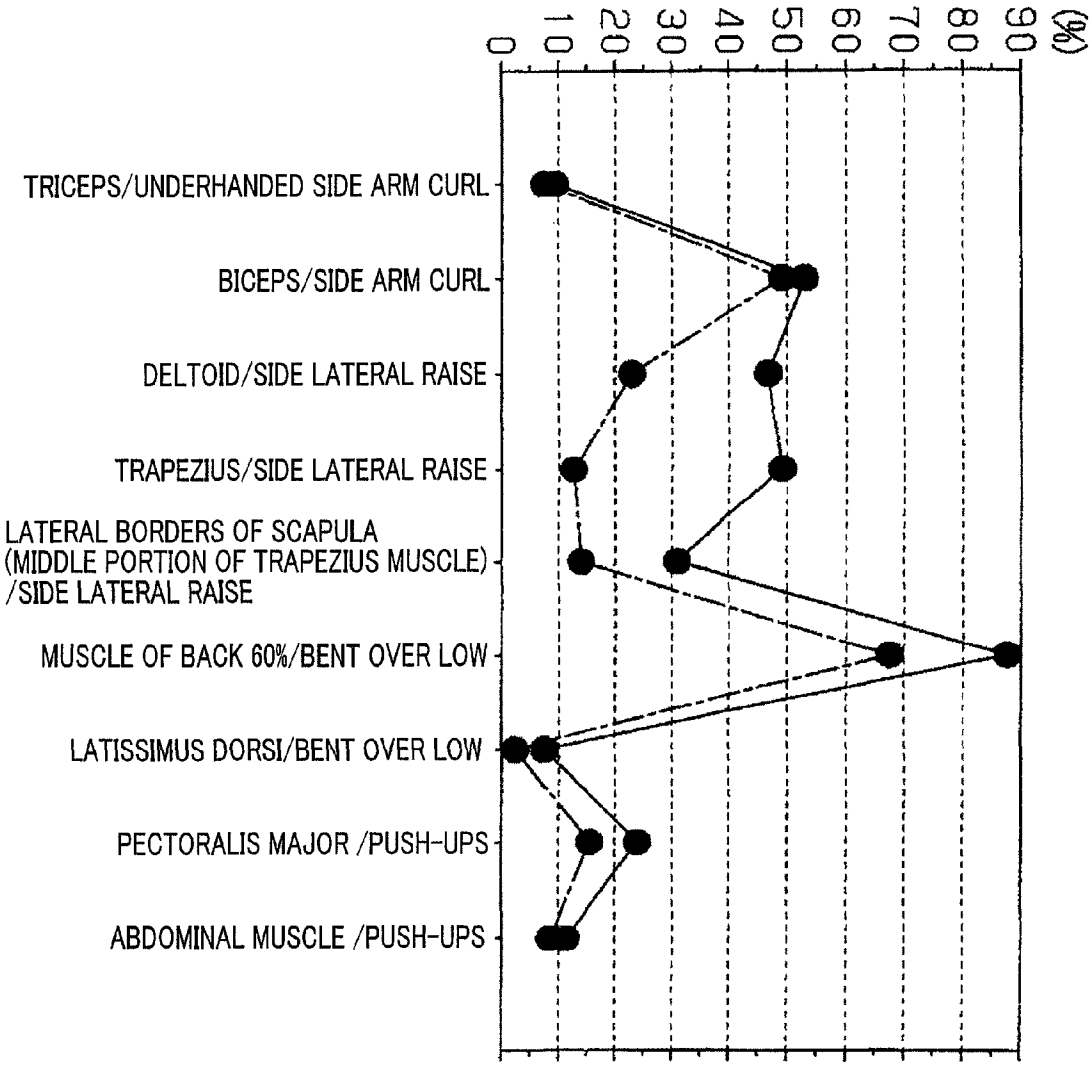
FIG. 14 is a view used to describe amounts of muscle activities.

As still another example, assume that the user is in a state where he stretches the elbows down as is shown in FIG. 13B and in a state where he stretches the elbows ahead and supports the reins 93 upward as is shown in 13A. In FIG. 14, an amount of exercise in the state of FIG. 13B is indicted by an alternate long and short dash line and an amount of exercise in the state of FIG. 13A is indicated by a solid line as in FIG. 11. It is understood from FIG. 14 that when the user uses the oscillation-type exercise device 91 in the posture shown in FIG. 13A, muscle activities are induced in the muscle of the back, the biceps, the trapezius, the deltoid, and the lateral borders of the scapula. Hence, it can be expected that the muscular strength in the respective regions can be increased.

As has been described in detail above, the following advantage can be achieved by this embodiment.

(1) The base ends of a pair of the reins 93 on the right and on the left are fixed to the front end of the seat portion 13. The reins 93 of this embodiment are made of a material having elasticity (rubber in this embodiment) and formed in a specific shape (for example, a tube-like shape). The handle portion 18, which has a ring-like portion formed almost in the shape of a ring so as to be gripped by the user, is attached to the tip end of each rein 93. The length of the reins 93 when unstretched is set in such a manner that the elbows of the user are bent at about 90 degrees. Hence, by oscillating the seat portion 13, it is possible to exert an exercise effect to the lower back and the legs of the user seated on the seat portion 13. Further, the reins 93 expand and contract with a variance of the interval between the seat portion 13 and the upper half of the body generated with the oscillations of the seat portion 13, and the expansion and contraction of the reins 93 in response to the motion of the upper half of the body gives rise to a variance in tensile force. Hence, a nerve reflex to achieve a balance is triggered in the user, and a muscle activity is induced in the upper half of the body (the arms, the chest, and so forth) of the user. It is thus possible to exert an exercise effect to the upper half of the body.

It should be appreciated that the respective embodiments above may be implemented in the following manners.

The reins 16 and 93 are formed in the shape of a tube in the respective embodiments above. However, the reins may be formed of a single string or plural strings either braided or unbraided. Alternatively, in the first embodiment above, bars may be used instead of the reins 16. Further, reins and bars may be used in combination.

Figure 15A:
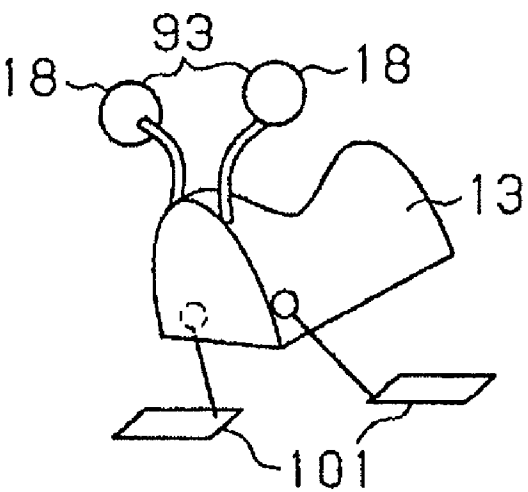
FIG. 15A and FIG. 15B are schematic views of other oscillation-type exercise devices.
Figure 15B:
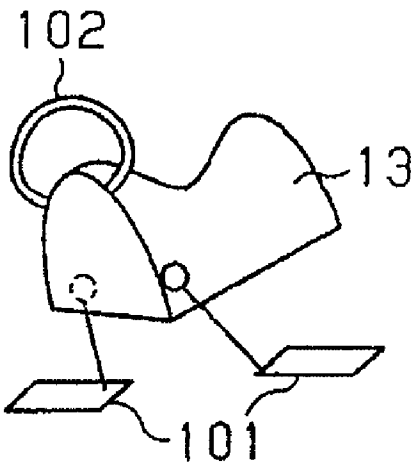

In the respective embodiments above, it may be configured in such a manner that, as is shown in FIG. 15A, stirrups 101 having loop portions for the user to put his feet in are provided. The stirrups 101 enable the user to hold the posture of the lower half of the body suitably during the oscillation exercise. The user therefore becomes able to practice exercise in a stable and correct posture. Also, when the user places his weight on the feet put in the stirrups 101, it is possible to intensively strengthen the quadriceps femoris that is closely related to the maintaining of the walking ability and prevention of gonalgia (pain in the knees). Alternatively, as is shown in FIG. 15B, a rein 102 shaped like a loop may be used. With the rein 102 formed in this manner, the user directly grips the rein 102 and holds the rein 102. Owing to the loop-like rein 102 and the stirrups 101, the user can manage the horseback riding posture as if he were riding on a real horse without having uncomfortable feeling.

Figure 16:
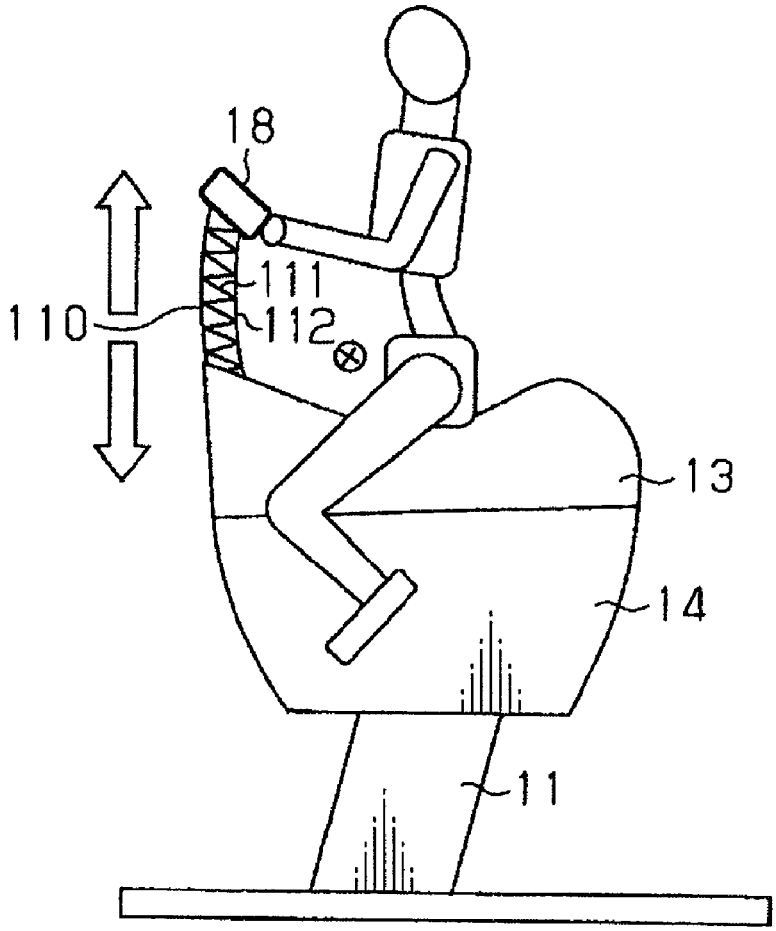
FIG. 16 is a side view schematically showing the overall configuration of still another oscillation-type exercise device of the second embodiment.
Figure 17A:
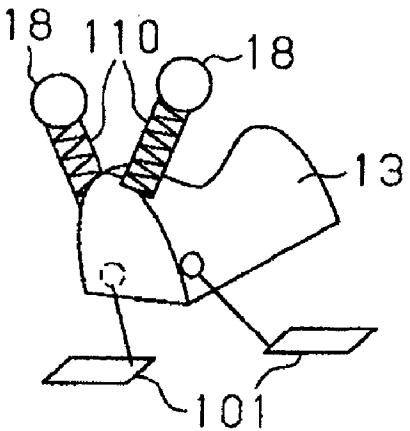
FIG. 17A through FIG. 17C are schematic views of still other oscillation-type exercise devices.
Figure 17B:
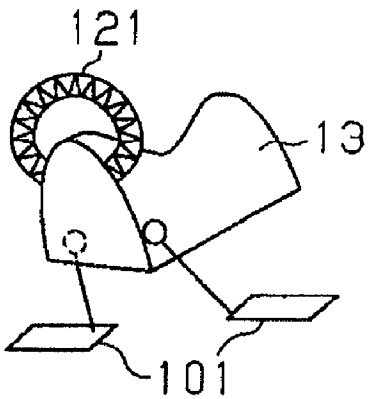
Figure 17C:
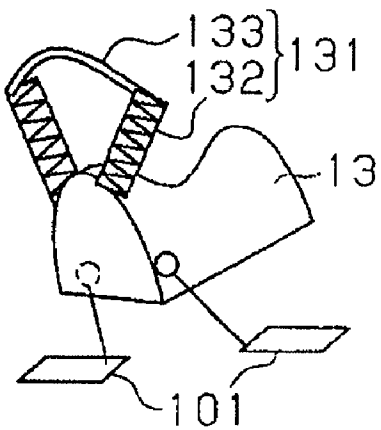

In the second embodiment above, the reins 93 are made of rubber in order to provide elasticity. However, as is shown in FIG. 16, it is possible to use reins 110 using springs 111, either entirely or partially, and covers 112 that cover the corresponding springs 111. It may be configured so as to provide the stirrups 101 to an exercise device having the reins 110 as is shown in FIG. 17A. Alternatively, as is shown in FIG. 17B, a rein 121 shaped like a loop and made of a spring may be used as well. Further, as is shown in FIG. 17C, reins 131 formed by combining springs 132 and a bar 133 may be used.

Figure 18B:
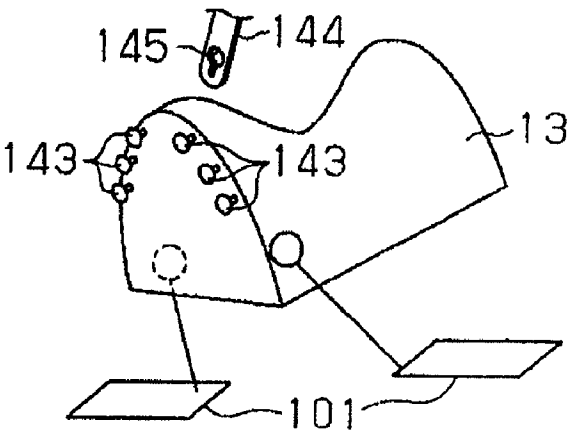
FIG. 18A and FIG. 18B are schematic views of still other oscillation-type exercise devices.
Figure 18A:
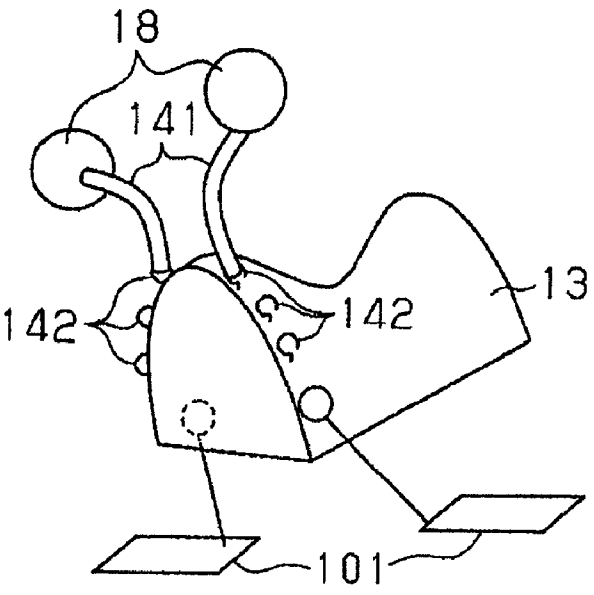

In the second embodiment above, it is configured in such a manner that the base ends of the reins 93 are fixed to the tip end on the top surface of the seat portion 13. However, as is shown in FIG. 18A, it may be configured in such a manner that reins 141 are coupled to the seat portion 13 in a detachable manner. To be more concrete, plural fixing portions 142 as fixing members are provided to the front end of the seat portion 13, and the reins 141 are formed so that they can be coupled to any of the fixing portions 142. The user therefore becomes able to select the fixing portions 142 to which the reins 141 are coupled. Alternatively, as is shown in FIG. 18B, it may be configured in such a manner that plural hinge pins 143 as fixing members are provided to the tip end of the seat portion 13 while a locking hole 145 is made in the base end of each rein 144. When configured in this manner, the fixed positions of the reins 144 can be changed by selecting the hinge pins 143 to which the reins 144 are coupled. Further, the length of the reins may be changed. For example, more than one locking hole 145 may be made in each rein in the configuration of FIG. 18B. When configured in this manner, the posture to hold the reins is changed, and so is the muscle used to hold the reins. Hence, the training can have a variation. Also, it becomes possible to address a difference of the physical frames, such as the length of the arms, among individual users, a change in the setting of the angle of the arms, and so forth. In addition, it is configured in such a manner that the base ends of the reins are disposed at the front end portion of the seat portion 13 in the respective embodiments above. The invention, however, is not limited to this configuration. As long as the reins are disposed in front of the user seated on the seat portion 13, the reins may be attached to points slightly displaced rearward from the front end portion of the seat portion 13.

Figure 19B:
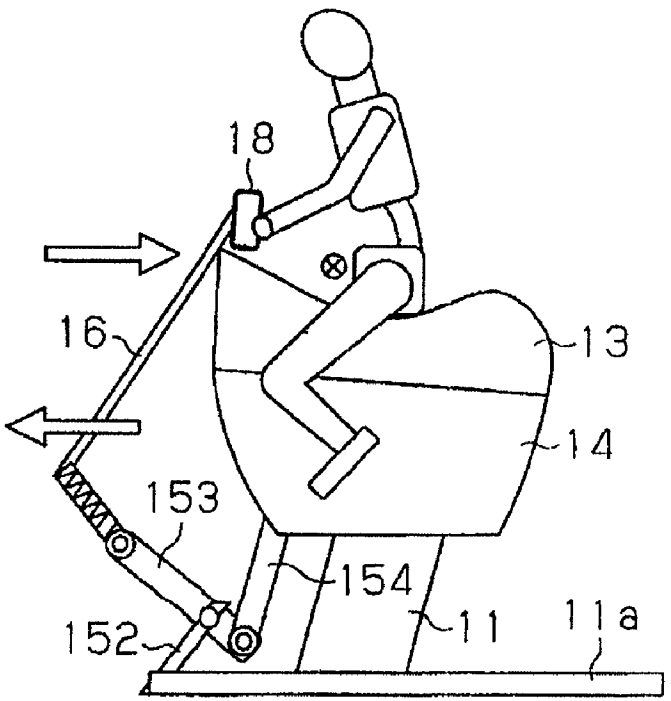
FIG. 19A and FIG. 19B are schematic views of still another oscillation-type exercise device.
Figure 19A:
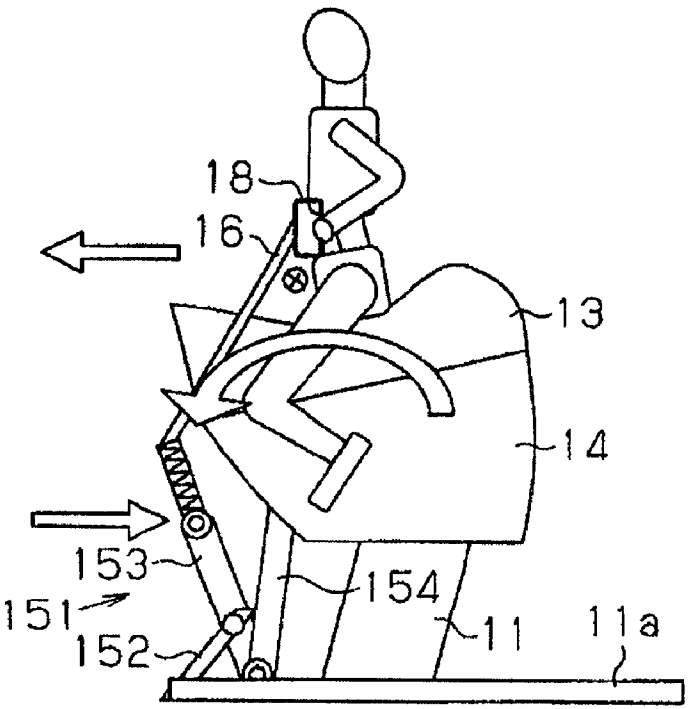

In the first embodiment above, it is configured in such a manner that the extensible mechanisms 17 are housed inside the seat portion 13. However, it may be configured in such a manner that the extensible mechanisms are provided to a portion other than the seat portion 13. For example, as is shown in FIG. 19A and FIG. 19B, an extensible mechanism 151 may be provided to the base 11*a* of the leg portion 11. In this case, a support portion 152 that supports the extensible mechanism 151 is provided to stand on the base 11*a*. An arm member 153 as a first member is supported on the supporting portion 152 in a rotatable manner. The base ends of the reins 16 are fixed to the tip end of the arm member 153. Meanwhile, the base end of the arm member 153 is coupled to the lower end (second end) of a shaft 154 as a second member in a rotatable manner. The upper end (first end) of the shaft 154 is coupled to the driving device 12 (or the cover 14) in a rotatable manner. In an oscillation-type exercise device provided with the extensible mechanism 151 configured as above, the arm member 153 oscillates via the driving device 12 (or the cover 14) with rotations of the motor 46, which not only causes the seat portion 13 to oscillate, but also causes the reins 16 to extend and retract. When configured in this manner, because the seat portion 13 can be oscillated and the reins 16 can be extended and retracted using the single motor, the number of the motors 46 can be lessened. Hence, not only can the control be simpler, but also the device can be reduced in both cost and size. It goes without saying that it may be configured in such a manner that a motor is provided to an extensible mechanism fixed to the base.

In the respective embodiments above, the handle portions attached to the reins may be formed so that they can be also used as the stirrups. In short, the handle portions may function as the loop portions in which the user puts his feet. When configured in this manner, in an oscillation-type exercise device provided with the reins alone, that is, suppressing an increase of the cost, the user is able to train the upper half of the body with a muscle activity induced by the reins on the one hand, and on the other hand, he is able to suitably maintain the posture of the lower half of the body by the stirrups during the oscillation exercise. Hence, the user becomes able not only to practice exercise in a stable and correct posture but also to strengthen the muscles of the lower half of the body.

In the first embodiment above, the oscillation of the seat portion 13 and the extension and retraction of the reins 16 are brought into synchronization. However, because it is sufficient to enable the user to move in achieving a balance of the upper half of the body, they are not necessarily brought into synchronization. Accordingly, the cycles of extension and retraction of the reins 16, that is, the rotation cycles of the motors 21 for extension and retraction, can be changed. The rotation cycles may be changed by a selection of the mode (the modes for beginners, for experienced users, and so forth).

In the first embodiment above, the rotation positions of a pair of the motors 21 on the right and on the left forming the extensible mechanisms 17 may be changed. In this case, the reins 16 on the right and on the left extend and retract separately, and the upper half of the body of the user is forced to twist. The user thus becomes able to train muscles relating to turning motion of the trunk.

SUMMARY OF THE EMBODIMENTS

The embodiments above can be summarized as follows.

(1) In the oscillation-type exercise devices of one of the embodiments above, because it is possible to generate a variance in tensile force with the extension and retraction of the rein in response to the motion of the upper half of the body, a nerve reflex to achieve a balance is triggered in the user, and a muscle activity is induced in the upper half of the body (the arms, the chest, and so forth) of the user. An exercise effect can be thus exerted to the upper half of the body.

(2) The extensible mechanism may include a motor and a rotary plate that is driven to rotate by the motor and to which is fixed a base end of the rein at a position displaced from a rotation center in a radial direction of the rotary plate. When configured in this manner, not only can the rein be extended and retracted with ease, but also the cycles of extension and retraction can be changed with ease by rotating the rotary plate by the driving of the motor.

(3) Each of the rein and the extensible mechanism may be provided to both right and left sides of the seat portion.

When configured in this manner, it is possible to bring the extension and retraction of the reins on the right and on the left into agreement or disagreement with each other. By causing the reins on the right and on the left to extend and retract separately, the upper half of the user is forced to twist. The user thus becomes able to train muscles relating to the turning motion of the trunk.

(4) A handle portion to be gripped by the user may be attached to a tip end of the rein. When configured in this manner, the rein can be held by the user more easily.

(5) In the oscillation-type exercise device described above, the extensible mechanism may include a second member whose first end portion is coupled to the exercise mechanism, and a first member whose base end is coupled to a second end portion of the second member in a rotatable manner and the base end of the rein is coupled to a tip end thereof. When configured in this manner, the rein is caused to extend and retract by oscillating the first member via the second member with oscillation motion of the exercise mechanism. It is thus possible to suppress an increase of the driving sources to cause the rein to extend and retract, which can in turn suppress an increase of the cost.

(6) The oscillation-type exercise device of the other one of the embodiments above includes: a seat portion on which a user is seated; an exercise mechanism that allows the seat portion to undergo oscillation motion; and a rein having elasticity and disposed in front of the user seated on the seat portion so as to be held by the user. According to this embodiment, the rein expands and contracts with a variance in interval between the seat portion and the upper half of the body caused by the oscillation of the seat portion. By generating a variance in tensile force from expansion and contraction of the rein in response to the motion of the upper half of the body, a nerve reflex to achieve a balance is triggered in the user, and a muscle activity is induced in the upper half of the body (the arms, the chest, and so forth) of the user. It is thus possible to exert an exercise effect to the upper half of the body.

(7) In the oscillation-type exercise device described above, the rein having the elasticity may be made of rubber entirely or partially. When configured in this manner, it is possible to provide a rein having elasticity with ease.

(8) In the oscillation-type exercise device described above, the rein having elasticity may be made of a spring entirely or partially. When configured in this manner, it is possible to provide a rein having elasticity with ease.

(9) In the oscillation-type exercise device described above, plural fixing members to which the rein is coupled may be provided, and the rein may be detachably attached to the fixing members. When configured in this manner, the posture to hold the rein changes as the fixing members to be coupled to the rein are changed. Muscles used to hold the rein are therefore changed, and a variation can be provided to the training. In addition, it becomes possible to address a difference of the physical frames, such as the length of the arms, among individual users, a change in the setting of the angle of the arms, and so forth.

(10) In the oscillation-type exercise device described above, the rein may be provided on right and left of the seat portion and handle portions may be provided to the reins while the handle portions are formed so as to be used as stirrups having loop portions in which the user puts his feet. When configured in this manner, in an oscillation-type exercise device provided with the reins alone, that is, suppressing an increase of the cost, the user is able to train the upper half of the body with a muscle activity induced by the reins on the one hand, and on the other hand, he is able to suitably maintain the posture of the lower half of the body by the stirrups during the oscillation exercise. Hence, the user becomes able not only to practice exercise in a stable and correct posture but also to strengthen the muscles of the lower half of the body.

(11) In the oscillation-type exercise device described above, the rein may be formed in a shape of a loop. When configured in this manner, the user becomes able to manage the horseback riding posture as if he were riding on a real horse without having uncomfortable feeling.

As has been described, according to the embodiments above, it is possible to provide an oscillation-type exercise device capable of exerting an exercise effect not only to the lower back and the legs but also to the upper half of the body.

This application is based on Japanese patent application serial no. 2007-140508, filed in Japan Patent Office on May 28, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An exercise device, comprising:

a seat configured for a user to sit;

an exercise mechanism that allows the seat to undergo oscillation motions;

a rein positioned in front of the user seated on the seat, the rein configured to be held by the user;

an extender configured to extend and retract the rein; and a controller configured to control the exercise mechanism and the extender such that the rein extends and retracts in synchronization with the oscillation motions.

2. The exercise device according to claim 1, wherein:

the extender includes a motor and a rotary plate driven to rotate by the motor, and a base end of the rein is fixed to the rotary plate at a position displaced from a rotation center in a radial direction of the rotary plate.

3. The exercise device according to claim 2, wherein:

the rein includes two reins; and the extender includes two extenders, such that each rein of the two reins and each extender of the two extenders, respectively, are provided to one of the right and left sides of the seat.

4. The exercise device according to claim 2, wherein:

a handle configured to be gripped by the user is attached to a tip end of the rein.

5. The exercise device according to claim 1, wherein:

the extender includes a first member having a base end and a tip end, and a second member having a first end portion and a second end portion;

the first end portion of the second member is coupled to the exercise mechanism;

the base end of the first member is coupled to the second end portion of the second member in a rotatable manner; and a base end of the rein is coupled to the tip end of the first member.

6. The exercise device according to claim 1, wherein:

the rein includes two reins and each rein of the two reins is provided on right and left sides of the seat, and handles are provided to each rein of the two reins; and the handles are configured to be used as stirrups having loop portions for feet of the user.

7. The exercise device according to claim 1, wherein:

the rein is formed in a shape of a loop.

8. An exercise device, comprising:

a seat configured for a user to sit;

an exercise mechanism that allows the seat to undergo oscillation motions; and a rein made of a spring entirely or partially, having elasticity and disposed in front of the user seated on the seat configured to be held by the user, wherein the seat comprises a plurality of fixing members configured to couple the rein to the seat, and the rein is detachably attached to the plurality of fixing members.

9. The exercise device according to claim 8, wherein: the rein is made of rubber entirely or partially.

10. The exercise device according to claim 8, wherein:

the rein includes two reins and each rein of the two reins is provided on right and left sides of the seat, and handles are provided to each rein of the two reins; and the handles are configured to be used as stirrups having loop portions for feet of the user.

11. The exercise device according to claim 8, wherein:

the rein is formed in a shape of a loop.

* * * * *